US007267756B2

(12) United States Patent
Nitta et al.

(10) Patent No.: US 7,267,756 B2
(45) Date of Patent: Sep. 11, 2007

(54) FINE ELECTROFORMING MOLD AND MANUFACTURING METHOD THEREOF

(75) Inventors: Koji Nitta, Osaka (JP); Shinji Inazawa, Osaka (JP); Akihisa Hosoe, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 391 days.

(21) Appl. No.: 10/503,496

(22) PCT Filed: Feb. 18, 2003

(86) PCT No.: PCT/JP03/01686

§ 371 (c)(1),
(2), (4) Date: Aug. 5, 2004

(87) PCT Pub. No.: WO03/071006

PCT Pub. Date: Aug. 28, 2003

(65) Prior Publication Data

US 2005/0115826 A1 Jun. 2, 2005

(30) Foreign Application Priority Data

Feb. 20, 2002 (JP) ..... 2002-042810

(51) Int. Cl.
*C25D 1/10* (2006.01)

(52) U.S. Cl. ..... 205/70; 205/50; 205/67; 205/75; 205/76; 205/78; 204/281

(58) Field of Classification Search ..... 204/281; 205/50, 67, 70, 75, 76, 78
See application file for complete search history.

(56) References Cited

U.S. PATENT DOCUMENTS 6,572,936 B1 * 6/2003 Domoto et al. ..... 427/577

(Continued)

FOREIGN PATENT DOCUMENTS

JP 50-119729 9/1975

(Continued)

*Primary Examiner*—Bruce F. Bell
(74) *Attorney, Agent, or Firm*—McDermott Will & Emery LLP

(57) ABSTRACT

The present invention provides a mold for fine electroforming M having a simple structure. In order to improve the productivity of a metal product, an electrode portion can be arranged with a much higher density, and a metal thin film formed on the electrode portion can easily be peeled off. The present invention provides a manufacturing method for manufacturing the mold M with a higher accuracy and by an easier way.

The mold for fine electroforming M has a conductive substrate 1 to function as a cathode during electroforming and insulation layer 2 having an opening 21, which has a shape corresponding to a shape of a plane shape of the metal product P and is through to the conductive substrate 1, and composed of an inorganic insulation material having a thickness $T_2$ of not less than 10 nm and less than one-half the thickness $T_1$ of the metal product P. The surface of the conductive substrate 1 exposed at the opening 21 is adapted to serve as the electrode portion.

The manufacturing method of the mold M has steps of: forming an inorganic thin film 2' to grow into the insulation layer 2 in an area excluding an area, where resist film R is pattern-formed, on the surface of the conductive substrate 1; and removing the resist film R to form the opening 21.

5 Claims, 4 Drawing Sheets

U.S. PATENT DOCUMENTS

| | | | | |
|---|---|---|---|---|
| 6,632,342 | B1 * | 10/2003 | Teshima et al. | 205/118 |
| 2004/0104739 | A1 * | 6/2004 | Haga et al. | 324/757 |

FOREIGN PATENT DOCUMENTS

| | | |
|---|---|---|
| JP | 51-37617 | 10/1976 |
| JP | 55-30076 | 8/1980 |
| JP | 59-34794 | 8/1984 |
| JP | 62-011179 | 1/1987 |
| JP | 9-217191 | 8/1997 |
| JP | 2002-097591 | 4/2002 |
| JP | 2002-173792 | 6/2002 |
| JP | 2003-508638 | 3/2003 |

* cited by examiner

FINE ELECTROFORMING MOLD AND MANUFACTURING METHOD THEREOF

TECHNICAL FIELD

The present invention relates to a new mold for fine electroforming used when a fine metal product composed of a metal thin film and having a predetermined plane shape and a predetermined thickness is manufactured by electroforming, and a manufacturing method for manufacturing the mold for fine electroforming.

BACKGROUND ART

Electroforming has some advantages. For example, (1) ultrahigh-precision processing can be performed, (2) a metal product integrated with a base material can be manufactured, and (3) a precise duplicate of a prototype can be manufactured. Electroforming is utilized for manufacturing various types of metal products such as a copper foil for a printed circuit board, an outer edge of an electric shaver, a precision screen, a face of a wrist watch, and a mold for forming a compact disk.

Particularly in recent years, the needs for a fine metal product of an overall size on the order of microns have tended to increase, as represented by the miniaturization of parts caused by the miniaturization of electronic apparatuses, and it has been examined that electroforming is applied to the manufacture thereof.

Examples of the fine metal product manufactured by electroforming include one that uses a metal thin film formed on a base material by electroforming, together with the base material, in an integrated state and one that uses a formed metal thin film as an independent product by peeling off the metal thin film from a base material.

Although the former metal product occupies almost all the fine metal products at present, it is expected that the use and the demand of the latter metal product increase from now on.

The latter metal product is manufactured by preparing a mold for fine electroforming comprising an electrode portion having a fine shape corresponding to its plane shape, making the electrode portion of the mold serve as a cathode, making a metal thin film selectively grow on its surface by electroforming, and then peeling off the metal thin film, which has grown, from the electrode portion and recovering the peeled metal thin film.

As an example of the mold for fine electroforming used for such a method are one obtained by forming on a surface of a conductive substrate such as a metal plate a resist film having insulating properties, and having a lot of openings having a shape corresponding to the plane shape of a metal product to be manufactured and through to the surface of the conductive substrate by lithography or the like, and using as an electrode portion the surface of the conductive substrate exposed through the openings of the resist film.

In the above-mentioned mold, the resist film mainly composed of an organic material such as resin is weak and is liable to be damaged. Moreover, the thickness thereof is significantly larger than the thickness of the metal thin film formed by electroforming. Therefore, it is difficult to peel off the formed metal thin film from the surface of the conductive substrate without damaging the resist film.

In the above-mentioned mold, therefore, it is considered that the resist film, together with the metal thin film, is peeled off every time electroforming is performed, considering that a rate of recovery in peeling off the metal thin film from the electrode portion and recovering the peeled metal thin film is improved.

When such a recovering method is carried out, however, the mold is made unusable every time electroforming is performed, and must be newly re-formed. Therefore, the productivity of the mold and the metal product manufactured using the mold are low, so that the production cost is significantly high.

Therefore, the inventors have proposed a mold for fine electroforming 9 having a structure-shown in FIG. 4 (Japanese Laid-Opened Patent Publication JP2002-97591A).

The mold for fine electroforming 9 is one obtained by forming a lot of very small projections 91 each having a front end surface 91*a* corresponding to the plane shape of a metal product by lithography or the like on a surface of a conductive substrate 90 composed of a metal plate, then causing liquid resin to flow thereonto to cure the resin to form an insulation layer 92 which is sufficiently thicker and stronger than a resist film, and then polishing a surface of the insulation layer 92 to expose the front end surface 91*a* of the projection 91 and make the exposed front end surface 91*a* serve as an electrode portion.

In the mold for fine electroforming 9, the insulation layer 92 is sufficiently thicker and stronger than the resist film, as described above, and the front end surface 91*a* of the projection 91 and the surface of the insulation layer 92 are nearly flush with each other. The metal thin film is formed in a shape projected upward from the flush surfaces. Accordingly, the metal thin film can be recovered by peeling off the insulation layer 92 without practically causing damage thereto. Consequently, the one mold for fine electroforming 9 can be reused for electroforming many times.

When the above-mentioned mold 9 is used, however, the metal thin film may not, in some cases, be easily peeled off. The cause thereof is that a so-called anchor effect is produced between the surface of the mold 9 and the metal thin film.

That is, in the above-mentioned mold 9, the front end surface 91*a* of the projection 91 tends to enter a state projected very slightly from the surface of the insulation layer 92 depending on the difference in the ease of wear at the time of polishing between the metal and the resin or contraction at the time of curing of the resin, in a case where the resin is curable resin.

Alternatively, a very small clearance may, in some cases, occur between a side surface of the projection 91 and the insulation layer 92 depending on the difference in a coefficient of expansion therebetween, contraction at the timing of curing of the above-mentioned curable resin, or the like.

During electroforming, the metal thin film grows not only on the front end surface 91*a*, but also on the side surface of the projection 91 exposed by the projection or the clearance, and the grown metal thin film of the side surface produces an anchor effect, so that the metal thin film, which has grown on the side of the front end surface 91*a*, made to serve as a metal product is not easy to peel off.

The metal thin film has a microstructure. When there occur situations where the metal thin film is difficult to peel off, as described above, therefore, the metal thin film is easily deformed and damaged by a stress created at the time of peeling, and the manufacturing yield of the fine metal product composed of the metal thin film is significantly lowered.

Furthermore, when an attempt to force the metal thin film to be peeled off by a strong force is made, an excessive force is also applied to the mold 9. Therefore, the degradation of the mold 9 becomes fast.

Particularly, the insulation layer 92 more easily wears away by a stress created in peeling off the metal thin film, for example, as compared with the projection 91 made of metal even if it is formed of curable resin such as epoxy resin. When the wear progresses, the side surface of the projection 91 is further greatly exposed. Therefore, it may be not only further difficult to peel off the metal thin film because the above-mentioned anchor effect is increased but also impossible to obtain a metal product having a correct shape because the metal thin film grown not only on the front end surface 91*a*, but also on the side surface of the projection 91 becomes too large.

Furthermore, the insulation layer 92 is peeled off from the conductive substrate 90 over a wide area by the above-mentioned stress or the like so that the mold may be entirely unusable.

In order to improve the productivity of the metal product, it is preferable that the number of metal products which can be manufactured by performing electroforming once using one mold is made as large as possible.

Therefore, it is needed to make the number of projections 91 as large as possible in the above-mentioned mold 9. In order to sufficiently ensure the thickness of the insulation layer 92, however, the aspect ratio of the projection 91, that is, the ratio of the diameter to the height of the projection 91 must be significantly higher than one. Therefore, it is by no means easy to form a lot of projections 91 having such a high aspect ratio on the surface of the conductive substrate 90 with a high density even by a current high-precision processing technique such as lithography.

In the above-mentioned mold 9, therefore, the improvement in the productivity of the metal product has a limitation.

DISCLOSURE OF THE INVENTION

An object of the present invention is to provide a new mold for fine electroforming that is as simple in structure and easy to manufacture as a conventional mold having an electrode portion formed therein by an opening of a resist film and therefore, is usable for a plurality of times of electroforming because an electrode portion can be arranged therein with a much higher density in order to improve the productivity of a metal product, a metal thin film is easier to peel off than a mold which is a combination of a projection made of metal and an insulation layer, and the durability thereof is approximately equal to or greater than that of the mold.

Another object of the present invention is to provide a manufacturing method for manufacturing such a mold for fine electroforming with a higher accuracy and by an easier way.

A mold for fine electroforming according to the present invention is a mold for fine electroforming for manufacturing a fine metal product composed of a metal thin film and having a predetermined plane shape and a predetermined thickness by electroforming, and characterized by comprising a conductive substrate to function as a cathode during electroforming; and an insulation layer composed of an inorganic insulation material having a thickness of not less than 10 nm and less than one-half the thickness of the metal product, formed on a surface of the conductive substrate, and said insulation layer having an opening having a shape corresponding to the plane shape of the metal product and through to the surface of the conductive substrate, for manufacturing the metal product by making the metal thin film selectively grow by electroforming on the surface of the conductive substrate exposed at the opening.

The mold according to the present invention has approximately the same structure as the conventional mold using the resist film except that the insulation layer is formed of the inorganic insulation material, and is simple in structure and is easy to manufacture.

Particularly, the insulation layer can be produced by pattern-forming a resist film having a plane shape corresponding to the plane shape of the metal product on the surface of the conductive substrate by lithography or the like, then forming an inorganic thin film to grow into the insulation layer on the surface of the conductive substrate by the vapor phase growth method or the like, and then removing the resist film to form the opening, for example.

According to the processing techniques, it is possible to increase the accuracy and precision in a range of a technical level which has already been established in the field of electronic apparatuses, for example.

According to the present invention, therefore, the electrode portion (the opening of the insulation layer) can be arranged with a much higher density, as compared with the above-mentioned mold having the projection made of metal, thereby making it possible to improve the productivity of the metal product more greatly than before.

Furthermore, the insulation layer is composed of the inorganic insulation material, and the thickness thereof is defined to not less than 10 nm. Therefore, the insulation layer is higher in hardness and strength, as compared with the conventional resist film having insulating properties. Therefore, the insulation layer has such a durability that it is not easily damaged by a stress created in peeling off the metal thin Moreover, the thickness of the insulation layer is defined to less than one-half the thickness of the metal product to be manufactured. After electroforming, there occurs a state where the metal thin film is projected from the insulation layer. Accordingly, only the metal thin film can be peeled off without peeling off nor damaging the insulation layer. Moreover, in peeling off the metal thin film, the metal thin film can be peeled off by a smaller stress without producing a strong anchor effect on a stepped surface as the peripheral part of the opening of the insulation layer.

According to the present invention, therefore, the insulation layer is prevented from being damaged at the time of peeling, thereby making it possible to also use the mold for a plurality of times of electroforming as one having a durability approximately equal to or greater than that of the conventional mold having the projection made of metal. Further, the metal product is prevented from being deformed and damaged by a stress created at the time of peeling, thereby making it possible to also improve the yield of the metal product more greatly than that of the conventional mold.

Considering that the metal thin film is much easily peeled off, it is preferable that the thickness of the insulation layer is not more than one-third the thickness of the metal product to be manufactured particularly in the above-mentioned range.

Employed as the insulation layer can be any of thin films composed of various types of inorganic materials which can form a film and having insulating properties. Considering that an insulation layer having higher strength and higher hardness is formed, however, it is preferable that at least its surface is formed of one, having insulating properties, of carbon thin films similar to diamond, that is, so-called diamond-like carbon thin films (hereinafter referred to as "DLC thin films").

Although the whole of the insulation layer may be formed of the above-mentioned DLC thin film having insulating properties, it is preferable that the insulation layer has a two-layered structure obtained by first forming an intermediate layer composed of a silicon (Si) or silicon carbide (SiC) thin film on the surface of the conductive substrate and then laminating a surface layer composed of the DLC thin film having insulating properties on the intermediate layer in order to improve adhesion of the DLC thin film to the conductive substrate to further improve the durability of the insulation layer.

The above-mentioned silicon or silicon carbide thin film is superior in adhesion to a metal such as a stainless steel, and also has the effect of forming SiC on an interface between the thin film and the DLC thin film having insulating properties laminated thereon to improve the adhesion of the DLC thin film.

An example of another factor which affects the durability of the insulation layer is corrosion resistance of the conductive substrate which is a base to electroforming. That is, when the conductive substrate corrodes during electroforming, the insulation layer formed thereon is peeled off and lost or floats, so that it is easily peeled off and damaged depending on a stress created in peeling off the metal thin film. When the surface of the electrode portion is made rough by the corrosion, there are possibilities that a clean metal thin film cannot be formed thereon, or the formed metal thin film cannot be peeled off from the electrode portion. Consequently, the conductive substrate is preferably formed of a material having conductive properties and superior in corrosion resistance and particularly, a stainless steel such as SUS316.

In order to further improve the corrosion resistance of the surface of the conductive substrate composed of the stainless steel such as SUS316, it is preferable that a conductive layer having corrosion resistance is formed on a surface, at least a portion of the surface exposed through the opening of the insulation layer, of the conductive substrate, to protect the conductive substrate.

Employed as a specific example of the conductive layer having corrosion resistance can be any of thin films composed of various types of inorganic materials which can form a film, having corrosion resistance, and having conductive properties. Considering that a conductive layer having higher strength and higher hardness and having corrosion resistance is formed, however, a titanium thin film is preferable.

The whole of the conductive substrate may be formed of titanium or a nickel corrosion resistant alloy having conductive properties as well as having the same corrosion resistance as that of the conductive layer.

A method of manufacturing a mold for fine electroforming according to the present invention is a method of manufacturing the above-mentioned mold for fine electroforming according to the present invention, comprising the steps of:

pattern-forming a resist film corresponding to the plane shape of the metal product on the surface of the conductive substrate;

forming a single-layered or multi-layered inorganic thin film to grow into the insulation layer by the vapor phase growth method in an area excluding an area, where the resist film is pattern-formed, on the surface of the conductive substrate; and removing the resist film, to form an opening having a shape corresponding to the plane shape of the metal product and through to the surface of the conductive substrate in the inorganic thin film.

In the manufacturing method according to the present invention, the resist film is formed by lithography or the like, as previously described, thereby making it possible to increase the accuracy and precision in the range of a technical level which has already been established in the field of electronic apparatuses to the same degree as that in the conventional mold using the resist film having insulating properties.

Moreover, according to the above-mentioned manufacturing method, the number of steps requiring high-accuracy positioning by lithography or the like is only one in pattern-forming the resist film. Therefore, the above-mentioned high-accuracy mold can be also manufactured by an easier way.

BEST MODE FOR CARRYING OUT THE INVENTION

The present invention will be described below.

(Mold for Fine Electroforming)

Figure 1A:
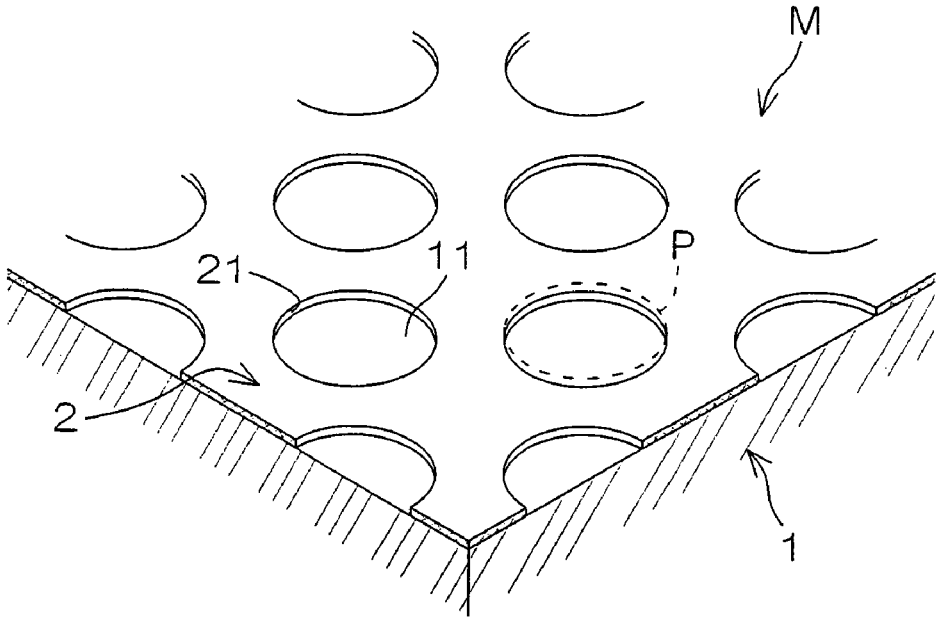
FIG. 1A is a partially cutaway view in perspective showing an example of an embodiment of a mold for fine electroforming according to the present invention in enlarged fashion.
Figure 1B:
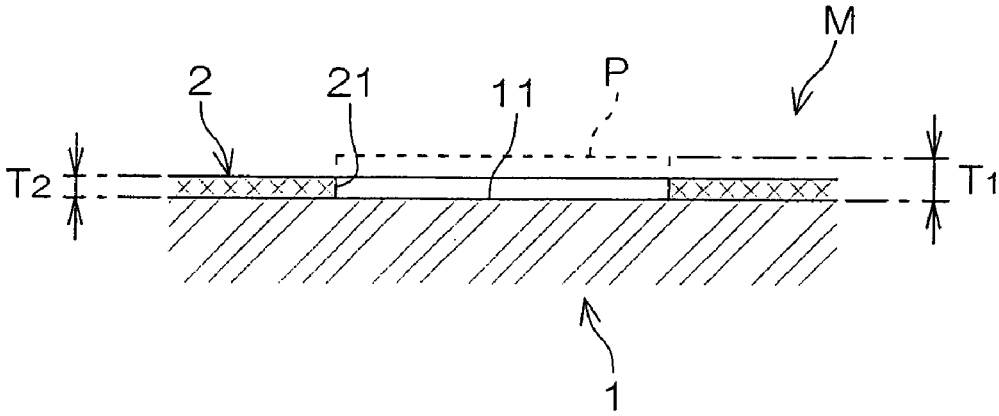
FIG. 1B is an enlarged sectional view further showing a part of the mold for fine electroforming in the above-mentioned example in enlarged fashion.

As described above, FIG. 1A is a partially cutaway view in perspective showing an example of an embodiment of a mold for fine electroforming according to the present invention in enlarged fashion, and FIG. 1B is an enlarged sectional view further showing a part of the mold for fine electroforming in the above-mentioned example in enlarged fashion.

A mold for fine electroforming M in the example as illustrated is for manufacturing as a metal product a metal powder P having the plane shape of a flat plate which is circular, that is, a disk shape. On a surface of its conductive substrate 1, an insulation layer 2 having a lot of openings 21 having a circular shape corresponding to the plane shape of the metal powder P is formed of an inorganic insulation material, and a surface 11 of the conductive substrate 1 exposed through the openings 21 of the insulation layer 2 is made to serve as an electrode portion.

Although at least the surface of the conductive substrate 1 out of the above-mentioned components may have conductive properties, it is preferable that the whole of the conductive substrate 1 is integrally formed of a metal plate or the like in order to simplify the structure thereof, and it is preferable that the whole thereof is integrally formed of a plate material made of a stainless steel such as SUS316, as described above, if consideration is particularly given to corrosion resistance or the like. Further, SUS316L which is particularly superior in corrosion resistance is most preferable as the stainless steel such as SUS316.

Furthermore, the whole of the conductive substrate 1 can be also formed of titanium, a nickel corrosion resistant alloy such as Hastelloy (a Ni—Cr—Mo alloy), or the like, as described above. In the case, the corrosion resistance can be further improved.

Employed as the insulation layer 2 can be any of thin films composed of various types of inorganic materials which can form a film and having insulating properties, as previously described. Examples of the thin films include a silicon oxide ($SiO_2$) thin film, an aluminum oxide ($Al_2O_3$) thin film, and a DLC thin film having insulating properties. The DLC thin film having insulating properties is preferable, particularly considering that the insulation layer 2 having high hardness and high strength is formed, as described above.

The hardness of the DLC thin film having insulating properties is preferably not less than 1000 in terms of Vickers hardness Hv, considering that the insulation layer 2 is given such hardness and strength that it is neither easily worn away nor damaged by a stress created in peeling off the metal thin film. Further, the specific resistance of the DLC thin film is preferably not less than $10^{11}$ Ω·cm, considering that an area, other than the electrode portion, of a surface of the mold M is sufficiently insulated.

The DLC thin film having insulating properties can be formed by the ion plating method, the sputtering method, the plasma CVD (Chemical Vapor Deposition) method or the like, and particularly, is preferably formed by the plasma CVD method.

In order to make the DLC thin film formed by the plasma CVD method have insulating properties, hydrocarbon gas such as methane gas may be used as raw material gas.

Figure 2A:
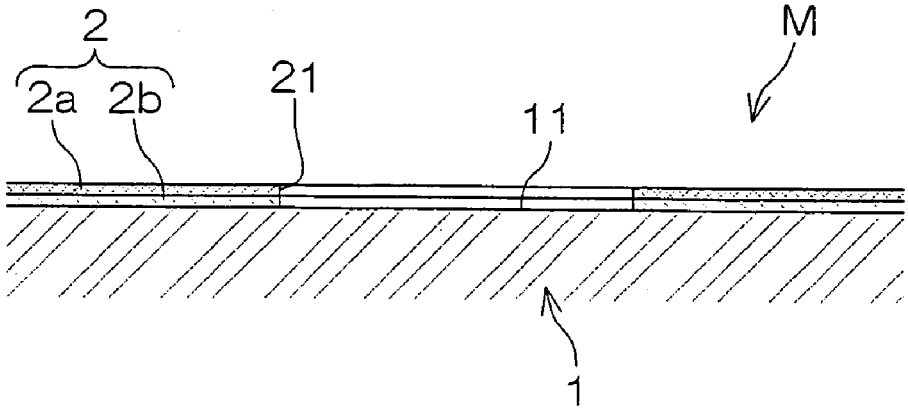
FIGS. 2A and 2B are enlarged sectional views respectively showing modified examples of the mold for fine electroforming according to the present invention.

Although the insulation layer 2 may have a single-layered structure as illustrated, it preferably has a two-layered structure comprising an intermediate layer 2*b*, composed of a silicon or silicon carbide thin film, formed on the surface of the conductive substrate 1 and a surface layer 2*a*, composed of a DLC thin film having insulating properties, laminated thereon, as illustrated in FIG. 2A, for example. The reason thereof is as described above. In a case where an alkali bath is used as a plating solution for electroforming, the intermediate layer 2*b* is more preferably formed of a silicon carbide thin film superior in alkali resistance out of the above-mentioned thin films.

The silicon thin film can be formed by the ion plating method, the sputtering method, the plasma CVD method or the like. Further, the silicon carbide thin film can be formed by the reactive ion plating method, the reactive sputtering method, the plasma CVD method or the like.

Referring to FIG. 1B, the thickness $T_2$ of the insulation layer 2 must be less than one-half the thickness $T_1$ of a metal product to be manufactured and not less than 10 nm. The reason thereof is as descried above.

That is, in a case where the thickness $T_2$ of the insulation layer 2 is less than 10 nm, the hardness and the strength of the insulation layer 2 are lowered. Therefore, the insulation layer 2 is liable to be damaged by a stress created in peeling off the metal thin film, so that the durability of the mold M is lowered. Further, sufficient insulating properties cannot be ensured depending on the material of the insulation layer 2.

Conversely, in a case where the thickness $T_2$ of the insulation layer 2 is not less than one-half the thickness $T_1$ of the metal product to be manufactured, a strong anchor effect is produced on a stepped surface as the peripheral part of the opening of the insulation layer 2. Therefore, the metal thin film is not easy to peel off and therefore, must be peeled off by a greater stress. Therefore, the metal product is deformed and damaged by a stress created at the time of peeling in more cases. Accordingly, the yield of the metal product is decreased, or the insulation layer 2 is liable to be damaged at the time of peeling, so that the durability of the mold M is lowered.

The thickness $T_2$ of the insulation layer 2 is not more than one-third the thickness $T_1$ of the metal product to be manufactured, and is preferably not less than 10 nm particularly in the above-mentioned range.

When a metal powder having a thickness $T_1$ of 1 μm is manufactured as a metal product, as in examples described later, the thickness $T_2$ of the insulation layer 2 must be not less than 10 nm and less than 500 nm, and is preferably 10 nm to 333 nm if it conforms to the above-mentioned definition.

The upper limit value of the thickness $T_2$ of the insulation layer 2 is thus defined only by the relationship with the thickness $T_1$ of the metal product, and the range of specific numerical values is not particularly limited. When the thickness $T_2$ of the insulation layer 2 is too large, however, the residual stress in the layer is increased. Accordingly, the insulation layer 2 is easily peeled off from the conductive substrate 1 by a stress created in peeling off the metal thin film, for example, during electroforming or after electroforming, so that the durability of the mold M may be lowered.

Therefore, the thickness $T_2$ of the insulation layer 2 is preferably not more than 5 μm, and more preferably not more than 1 μm irrespective of the thickness of the metal product.

When the insulation layer 2 has a single-layered structure, as in the example shown in FIG. 1A, the thickness $T_2$ of the insulation layer 2 described above is the thickness of its own. When the insulation layer 2 has a two-layered structure comprising the surface layer 2*a* and the intermediate layer 2*b*, as in the example shown in FIG. 2A, the thickness $T_2$ is the thickness of the sum of both the layers.

The ratio $T_{2a}/T_{2b}$ of the thickness $T_{2a}$ of the surface layer 2*a* composed of the DLC thin film having insulating properties to the thickness $T_{2b}$ of the intermediate layer 2*b* composed of the silicon or silicon carbide thin film is preferably 2/8 to 8/2, and more preferably 3/7 to 7/3.

When the thickness $T_{2a}$ of the surface layer 2*a* is smaller than the range, the effect of increasing the strength and the hardness of the insulation layer 2 by the surface layer 2*a* is insufficient. Conversely, when the thickness $T_{2b}$ of the intermediate layer 2*b* is smaller than the range, the effect of improving adhesion of the surface layer 2*a* to the conductive substrate 1 by the intermediate layer 2*b* is lowered. In either case, therefore, the durability of the insulation layer 2 may be lowered.

Figure 2B:
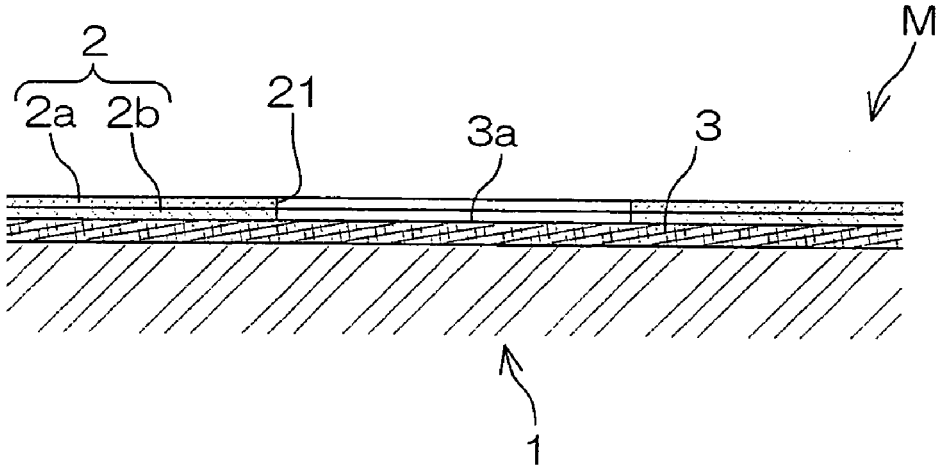

The conductive layer 3 having corrosion resistance may be formed on at least a surface, exposed through the openings 21 of the insulation layer 2, of the conductive substrate 1 composed of a stainless steel, and more preferably the whole of a surface of the conductive substrate 1, as shown in FIG. 2B.

In such a configuration, a surface 3*a*, exposed through the openings 21 of the insulation layer 2, of the conductive layer 3 having corrosion resistance is made to serve as an electrode portion.

A titanium thin film is preferable, as described above, as the conductive layer 3 having corrosion resistance.

The titanium thin film can be formed by the ion plating method, the sputtering method, the plasma CVD method or the like. The titanium thin film formed by the sputtering method out of the methods is particularly preferable because it is superior in corrosion resistance, is also superior in adhesion to the stainless steel, and is high in strength and hardness.

The thickness of the conductive layer 3 having corrosion resistance, for example, the titanium thin film is preferably 10 nm to 10 μm, and more preferably 50 nm to 2 μm.

In a case where the thickness of the conductive layer 3 is less than 10 nm, the effect of giving corrosion resistance to the conductive substrate 1 may not be sufficiently obtained. Further, even if the thickness thereof exceeds 10 μm, it is not only impossible to obtain the greater effect but also easy to peel off the conductive layer 3 from the conductive substrate 1 by a stress created in peeling off the metal thin film during electroforming or after electroforming because the residual stress in the film is increased, so that the durability of the mold M may be lowered.

(Method of Manufacturing Mold for Fine Electroforming)

FIGS. 3A to 3E are cross-sectional views showing an example of the steps of manufacturing the mold for fine electroforming M in the above-mentioned example shown in FIG. 1A by the manufacturing method according to the present invention.

Figure 3A:
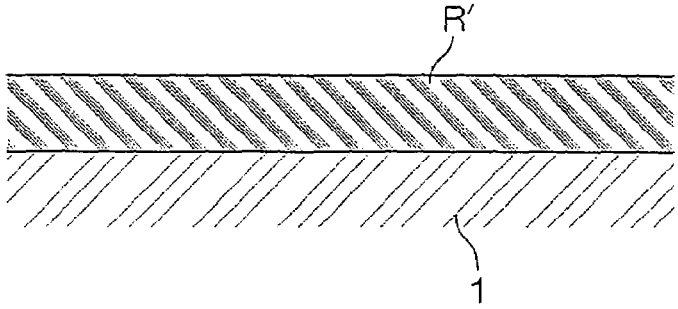
FIGS. 3A to 3E are cross-sectional views showing an example of the steps of manufacturing the mold for fine electroforming in the example shown in FIG. 1A by a manufacturing method according to the present invention.

In the manufacturing method according to the present invention, a resist agent is first applied to a surface of a conductive substrate 1 and is dried, to form a resist film R', as shown in FIG. 3A.

When a conductive layer having corrosion resistance is laminated on the surface of the conductive substrate 1, the laminating step is previously carried out before the forming step.

Figure 3B:
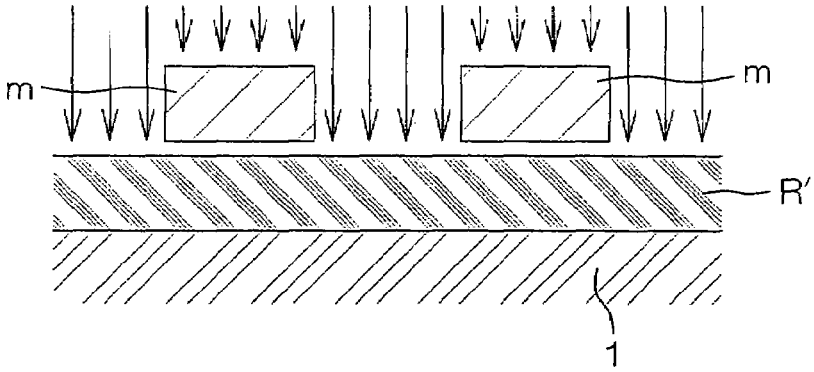
Figure 3C:
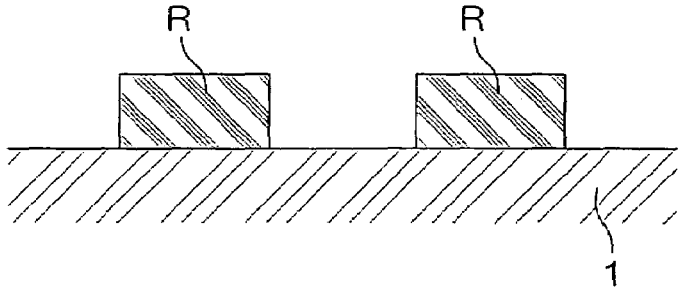

The resist film R' is then exposured, as indicated by a solid-line arrow in a state where a mask m whose plane shape corresponding to the plane shape of a metal product to be manufactured is pattern-formed is put on the resist film R', and is then developed using a predetermined developing solution, as shown in FIG. 3B, to pattern-form a resist film R having the above-mentioned plane shape, as shown in FIG. 3C.

Figure 3D:
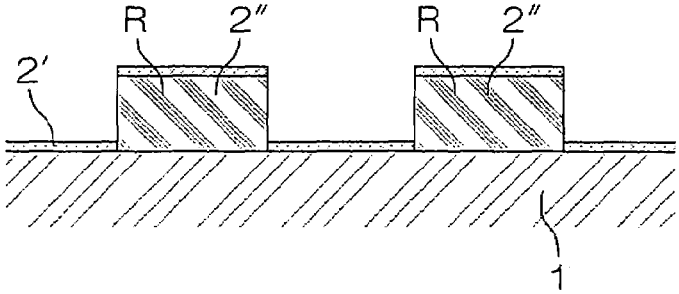

Inorganic thin films 2' and 2" to grow into the insulation layer 2 are then formed on the surface of the conductive substrate 1 and the resist film R by the above-mentioned vapor phase growth method such as the ion plating method or the sputtering method, as shown in FIG. 3D. When the insulation layer 2 has a two-layered structure, as described above, the film formation step shown in FIG. 3D is repeatedly carried out with respect to each of the layers.

Figure 3E:
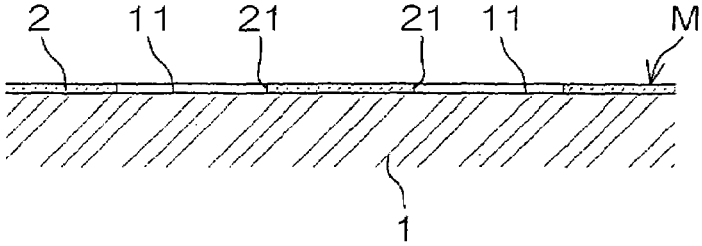

When the resist film R and the inorganic thin film 2" formed thereon are removed, the insulation layer 2 comprising the opening 21 having a plane shape corresponding to the plane shape of the metal product, as shown in FIG. 3E, thereby manufacturing a mold for fine electroforming M.

INDUSTRIAL APPLICABILITY

As described in the foregoing, the mold for fine electroforming according to the present invention is as simple in structure and easy to manufacture as a conventional mold having an electrode portion formed therein by an opening of a resist film and therefore, an electrode portion can be arranged with a much higher density in order to improve the productivity of a metal product. Further, the mold for fine electroforming is usable for a plurality of times of electroforming because a metal thin film is easier to peel off than that in a mold which is a combination of a projection made of metal and an insulation layer, and the durability thereof is approximately equal to or greater than that of the mold.

In the manufacturing method according to the present invention, the mold for fine electroforming according to the present invention can be manufactured with a higher accuracy and by an easier way.

EXAMPLES

The present invention will be described on the basis of examples and comparative examples.

Example 1

(Manufacture of Mold for Fine Electroforming)

In procedures shown in FIGS. 3A to 3E, a resist pattern having a lot of resist films R having a diameter of 30 μm corresponding to the shape of a metal powder (nickel powder) P in a disk shape distributed therein was first formed by the photolithography on one surface of a steel plate (a conductive substrate) 1 made of a stainless steel (SUS316L) 200 mm in length by 300 mm in breadth. The thickness of the resist film R was 20 μm.

Silicon oxide ($SiO_2$) thin films (inorganic thin films) 2' and 2" having a thickness of 0.2 μm to grow into an insulation layer 2 were then formed by the sputtering method on the surface, on which the resist pattern was formed, of the steel plate 1.

The steel plate 1 was then dipped in a 5% sodium hydroxide solution to dissolve the resist film R, so that the steel plate 1, together with the silicon oxide thin film 2" formed thereon, was removed, then rinsed, and dried.

Consequently, an insulation layer 2 having a thickness $T_2$ of 0.2 μm (=200 nm), which has a lot of openings 21 having a circular shape corresponding to the shape of the metal powder P and having a diameter of 30 μm was formed in a trace from which the resist film R has been removed, and a surface 11 of the steel plate 1 exposed through the openings 21 of the insulation layer 2 was made to serve as an electrode portion, to manufacture a mold for fine electroforming m having a laminated structure shown in FIGS. 1A and 1B. The thickness $T_2$ of the insulation layer 2 is one-fifth the thickness ($T_1$=1 μm) of the nickel powder serving as a metal product, described later.

(Manufacture of Metal Product)

Nickel was electroformed under conditions of a liquid temperature of 60° C. during air bubbling using the above-mentioned mold M and a nickel plating solution (pH=3) having the following composition:

| (component) | (concentration) |
|---|---|
| nickel sulfate hexahydrate | 200 g/liter |
| nickel chloride hexahydrate | 40 g/liter |
| boric acid | 30 g/liter |
| saccharin | 4 g/liter |

Nickel was electroformed by performing energization for 30 seconds at a direct current of 10 A/dm$^2$ using the mold M as a cathode and a nickel plate as an anode, thereby making a nickel thin film selectively grow in the electrode portion of the mold M.

A non-woven fabric made of polypropylene was pressed against the mold M after electroforming and was rubbed, thereby peeling off the nickel thin film formed on the electrode portion to produce nickel powders.

When the obtained nickel powders were observed using a scanning-type electron microscope (SEM), it was confirmed that any of the powders was a disk-shaped powder having a diameter of 30 μm and having a thickness of 1 μm, which was neither defective nor deformed. Further, the nickel thin film did not remain at all on the surface of the mold M.

When the same electroforming and peeling operations as described above were then repeatedly performed using the same mold M, the shape of the nickel powder which is a metal product was not changed, the nickel thin film did not remain at all on the surface of the mold M, and damage to the mold M was not confirmed until the ninth electroforming and peeling operations. When the tenth peeling operation was performed, however, it was found out that the insulation layer 2 was peeled off and cracked. When the eleventh electroforming was performed, an abnormality in the shape of the nickel powder was confirmed in a portion where the insulation layer 2 was peeled off and cracked.

Example 2

A mold for fine electroforming M having a laminated structure shown in FIGS. 1A and 1B was manufactured in the same manner as that in the example 1 except that an insulation layer 2 was formed of a DLC thin film having insulating properties (Vickers hardness Hv: 1100, and specific resistance: $10^{12}$ Ω·cm) having a thickness $T_2$ of 0.2 μm [=200 nm, which is one-fifth the thickness ($T_1$=1 μm) of a nickel powder serving as a metal product] by the plasma CVD method.

When electroforming and peeling operations were repeatedly performed in the same manner as those in the example 1 except that the mold M was used, the shape of the nickel powder which is a metal product was not changed, the nickel thin film did not remain at all on the surface of the mold M, and damage to the mold M was not confirmed until the 19-th electroforming and peeling operations. When the 20-th peeling operation was performed, however, it was found out that the insulation layer 2 was peeled off and cracked. When the 21-th electroforming was performed, an abnormality in the shape of the nickel powder was confirmed in a portion where the insulation layer 2 was peeled off and cracked.

Example 3

A mold for fine electroforming M having a laminated structure shown in FIG. 2A was manufactured in the same manner as that in the example 1 except that an insulation layer 2 had a two-layered structure comprising an intermediate layer 2*b* composed of a silicon thin film by the sputtering method and a surface layer 2*a* composed of a DLC thin film having insulating properties (Vickers hardness Hv: 1100, and specific resistance: $10^{12}$ Ω·cm) by the plasma CVD method and having a total thickness of 0.2 μm [=200 nm, which is one-fifth the thickness ($T_1$=1 μm) of a nickel powder serving as a metal product] The ratio $T_{2a}/T_{2b}$ of the thickness $T_{2a}$ of the surface layer 2*a* to the thickness $T_{2b}$ of the intermediate layer 2*b* was set to ⅓.

When electroforming and peeling operations were repeatedly performed in the same manner as those in the example 1 except that the mold M was used, the shape of the nickel powder which is a metal product was not changed, the nickel thin film did not remain at all on the surface of the mold M, and damage to the mold M was not confirmed until the 49-th electroforming and peeling operations. When the 50-th peeling operation was performed, however, it was found out that the insulation layer 2 was peeled off and cracked. When the 51-th electroforming was performed, an abnormality in the shape of the nickel powder was confirmed in a portion where the insulation layer 2 was peeled off and cracked.

Example 4

A conductive layer 3 (100 nm in thickness) having corrosion resistance composed of a titanium thin film was formed by the sputtering method on one surface of a steel plate made of a stainless steel (SUS316L) 300 mm in length by 200 mm in breadth was formed as a conductive substrate 1.

An insulation layer 2 having a two-layered structure comprising an intermediate layer 2*b* composed of a silicon thin film and a surface layer 2*a* composed of a DLC thin film having insulating properties (Vickers hardness Hv: 1100, and specific resistance: $10^{12}$ Ω·cm) was then formed in the same manner as that in the example 3 on the conductive layer 3, to manufacture a mold for fine electroforming M having a laminated structure shown in FIG. 2B. The thickness of the sum of both the layers was set to 0.2 μm [=200 nm, which is one-fifth the thickness ($T_1$=1 μm) of a nickel powder serving as a metal product], and the ratio $T_{2a}/T_{2b}$ of the thickness $T_{2a}$ of the surface layer 2*a* to the thickness $T_{2b}$ of the intermediate layer 2*b* was set to ⅓.

When electroforming and peeling operations were repeatedly performed in the same manner as those in the example 1 except that the mold M was used, the shape of the nickel powder which is a metal product was not changed, the nickel thin film did not remain at all on the surface of the mold M, and damage to the mold M was not confirmed until the 100-th electroforming and peeling operations.

Example 5

An insulation layer 2 having a two-layered structure comprising an intermediate layer 2*b* composed of a silicon thin film and a surface layer 2*a* composed of a DLC thin film having insulating properties (Vickers hardness Hv: 1100, and specific resistance: $10^{12}$ Ω·cm) was formed in the same manner as that in the example 3 except that a titanium plate 300 mm in length by 200 mm in breadth was used as the conductive substrate 1, to manufacture a mold for fine electroforming N having a laminated structure shown in FIG. 2A. The thickness of the sum of both the layers was set to 0.2 μm [=200 nm, which is one-fifth the thickness ($T_1$=1 μm) of a nickel powder serving as a metal product], and the ratio $T_{2a}/T_{2b}$ of the thickness $T_{2a}$ of the surface layer 2*a* to the thickness $T_{2b}$ of the intermediate layer 2*b* was set to ⅓.

When electroforming and peeling operations were repeatedly performed in the same manner as those in the example 1 except that the mold M was used, the shape of the nickel powder which is a metal product was not changed, the nickel thin film did not remain at all on the surface of the mold M, and damage to the mold M was not confirmed until the 100-th electroforming and peeling operations.

Example 6

A mold for fine electroforming M having a laminated structure shown in FIGS. 1A and 1B was manufactured in the same manner as that in the example 2 except that the thickness of an insulation layer 2 composed of a DLC thin film having insulating properties was set to 0.35 μm [=350 nm, which is 1/2.9 the thickness ($T_1$=1 μm) of a nickel powder serving as a metal product].

When electroforming and peeling operations were performed in the same manner as those in the example 1 except that the mold M was used, 80% of a nickel thin film could be peeled off without being defective nor deformed. However, the remaining 20% thereof was not peeled off at all, or was defective and deformed, even if it could be peeled off. This proved that the thickness of the insulation layer 2 was more preferably not more than one-third the thickness of the metal product.

Comparative Example 1

A mold for fine electroforming M having a laminated structure shown in FIGS. 1A and 1B was manufactured in the same manner as that in the example 2 except that the thickness of an insulation layer 2 composed of a DLC thin film having insulating properties was set to 0.5 μm [=500 nm, which is one-half the thickness ($T_1$=1 μm) of a nickel powder serving as a metal product].

When electroforming and peeling operations were performed in the same manner as those in the example 1 except that the mold M was used, a nickel thin film could not be peeled off at all.

This proved that the thickness of the insulation layer 2 had to be less than one-half the thickness of the metal product.

Comparative Example 2

A mold for fine electroforming M having a laminated structure shown in FIGS. 1A and 1B was manufactured in the same manner as that in the example 1 except that the thickness of an insulation layer 2 composed of a silicon oxide thin film was set to 8 nm.

When electroforming was performed in the same manner as that in the example 1 except that the mold M was used, it was confirmed that a nickel thin film grew in a shape protruding particularly toward the periphery of an opening 21, because insulation provided by the insulation layer 2 was insufficient. When a peeling operation was performed, it was confirmed that the insulation layer 2 was peeled off in places such as a place where the nickel thin film protruded and grew, as described above. Further, the peeled metal product was deformed by the above-mentioned protrusion.

This proved that the thickness of the insulation layer 2 had to be not less than 10 nm.

Comparative Example 3

A lot of columnar projections 91 having a diameter of 30 μm and having a height of 7 μm were formed by carrying out etching using lithography on one surface of a steel plate (a conductive substrate) 90 made of a stainless steel (SUS316L) 200 mm in length by 300 mm in breadth.

Figure 4:
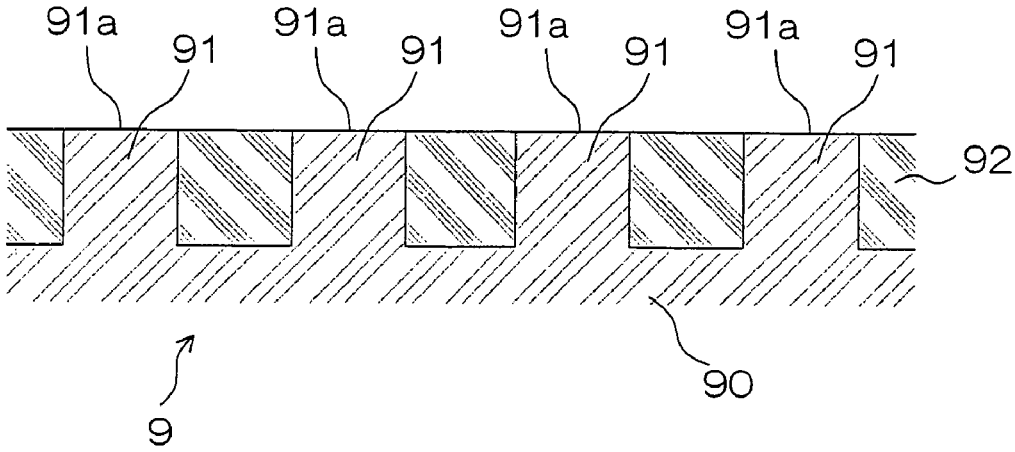
FIG. 4 is an enlarged sectional view showing a part of an example of a conventional mold for fine electroforming in enlarged fashion.

After a liquid epoxy resin was then caused to flow onto the surface, on which the productions 91 were formed, of the substrate 90, and was cured to form an insulation layer 92 having a thickness of 7 μm, the surface thereof was polished using sand paper of #2000, to expose a front end surface 91*a* of the projection 91 and make the exposed front end surface 91*a* serve as an electrode portion, thereby manufacturing a mold for fine electroforming 9 having a laminated structure shown in FIG. 4.

When electroforming and peeling operations were performed in the same manner as those in the example 1 except that the mold 9 was used, a nickel thin film was difficult to peel off. When the nickel thin film was forced to be peeled off using a metal spatula, any of nickel powders obtained by the peeling was defective and deformed. Further, in the mold 9 obtained after the nickel thin film was forced to be peeled off, a chip in the insulation layer 92, a surface scratch on the front end surface 91*a*, and so on were also found.

When the surface of the mold 9 before electroforming was observed using a microscope, a lot of places such as a place where the front end surface 91*a* of the projection 91 was projected by not less than 2 μm from a surface of the insulation layer 92 and a place where there occurred a clearance between a side surface of the projection 91 and the insulation layer 92 were confirmed.

The invention claimed is:

1. A mold for fine electroforming for manufacturing a fine metal product composed of a metal thin film and having a predetermined plane shape and a predetermined thickness by electroforming, comprising:

a conductive substrate to function as a cathode during electroforming; and an insulation layer composed of an inorganic insulation material having a thickness of not less than 10 nm and less than one-half the thickness of the metal product, formed on a surface of the conductive substrate, wherein the insulation layer having an opening having a shape corresponding to the plane shape of the metal product and forming through to the surface of the conductive substrate, for manufacturing the metal product by making the metal thin film selectively grow by electroforming on the surface of the conductive substrate exposed at the opening, the conductive substrate formed of a SUS316 type stainless steel, a conductive layer having corrosion resistance and composed of a titanium thin film, the conductive layer formed at least on a surface exposed through the opening of the insulation layer in the conductive substrate, and the insulation layer formed of a two-layered structure having an intermediate layer composed of a silicon or silicon carbide thin film and a surface layer composed of a diamond-like carbon thin film.

2. The mold for fine electroforming according to claim 1, wherein the thickness of the insulation layer is not more than one-third the thickness of the metal product.

3. A mold for fine electroforming for manufacturing a fine metal product composed of a metal thin film and having a predetermined plane shape and a predetermined thickness by electroforming, comprising:

a conductive substrate to function as a cathode during electroforming; and an insulation layer composed of an inorganic insulation material having a thickness of not less than 10 nm and less than one-half the thickness of the metal product, formed on a surface of the conductive substrate, wherein the conductive substrate is formed of titanium or a nickel corrosion resistant alloy, and the insulation layer is formed of a two-layered structure having an intermediate layer composed of a silicon or silicon carbide thin film and a surface layer composed of a diamond-like carbon thin film.

4. A method of manufacturing the mold for fine electroforming according to claim 1 or 3, comprising:

pattern-forming a resist film corresponding to the plane shape of the metal product on the surface of the conductive substrate;

forming a single-layered or multi-layered inorganic thin film to grow into the insulation layer by a vapor phase growth method in an area excluding an area where the resist film is pattern-formed, on the surface of the conductive substrate; and removing the resist film, to form an opening having a plane shape corresponding to the plane shape of the metal product and through to the surface of the conductive substrate in the inorganic thin film.

5. The mold for fine electroforming according to claim 4, wherein the thickness of the insulation layer is not more than one-third the thickness of the metal product.

* * * * *